United States Patent [19]

Green

[11] 4,167,235

[45] Sep. 11, 1979

[54] LOOSE FILL DISPENSING AND STORAGE SYSTEM

[75] Inventor: James R. Green, Buena Park, Calif.

[73] Assignee: Altainer, Inc., Pico Rivera, Calif.

[21] Appl. No.: 658,413

[22] Filed: Feb. 17, 1976

[51] Int. Cl.[2] ..... B65D 33/14

[52] U.S. Cl. ..... 222/105; 222/181; 222/630; 222/478; 222/500; 150/1; 406/135

[58] Field of Search ..... 222/105, 181, 500, 193, 222/478; 150/1, DIG. 1; 302/57; 229/DIG. 14

[56] References Cited

U.S. PATENT DOCUMENTS

| | | | |
|---|---|---|---|
| 1,233,784 | 7/1917 | Hutchison | 150/12 |
| 1,863,418 | 6/1932 | Sieling | 150/1 |
| 2,102,311 | 12/1937 | Fisher et al. | 222/500 X |
| 2,811,178 | 10/1957 | Cunningham | 150/1 UX |
| 3,374,929 | 3/1968 | Silfverskiold | 222/105 |
| 3,628,720 | 12/1971 | Lengerich | 150/1 X |
| 3,924,781 | 12/1975 | Witte | 222/181 X |

FOREIGN PATENT DOCUMENTS

| | | | |
|---|---|---|---|
| 523764 | 4/1931 | Fed. Rep. of Germany | 150/1 |
| 1536135 | 2/1970 | Fed. Rep. of Germany | 229/DIG. 14 |
| 942154 | 9/1948 | France | 302/57 |
| 1185581 | 2/1959 | France | 222/105 |
| 365017 | 11/1962 | Switzerland | 229/DIG. 14 |
| 413476 | 12/1966 | Switzerland | 222/181 |

*Primary Examiner*—David A. Scherbel
*Assistant Examiner*—Frederick R. Handren
*Attorney, Agent, or Firm*—Fraser and Bogucki

[57] ABSTRACT

A storage, shipping and dispensing system for loose fill packaging material comprises a collapsible pliant, vented cylindrical bag having an upper and a lower end including a dispensing apertured neck. Rings are circumferentially spaced apart about the bag adjacent both the upper and lower ends. The rings adjacent the upper end are coupled to suspend the bag in a dispensing mode and the rings adjacent the lower end encircle at stiff resilient hoop encompassing and maintaining the lower end of the bag in a radially extended nominal shape. A vertically adjustable support arrangement includes a circular rim having a plurality of spaced-apart hooks to support the rings of the bag. The bag may be readily filled in an inverted position with a large volume, such as in excess of 100 cubic feet, of expanded plastic loose fill material. Despite its size, the filled container may be easily handled during shipping and storage. The dispensing apertured neck may be used at a single packaging station when coupled to a dispensing valve, or coupled to an air conveyor system comprising a blower driven transfer chute for duct feeding loose fill to multiple remote stations.

5 Claims, 9 Drawing Figures

Fig. 1
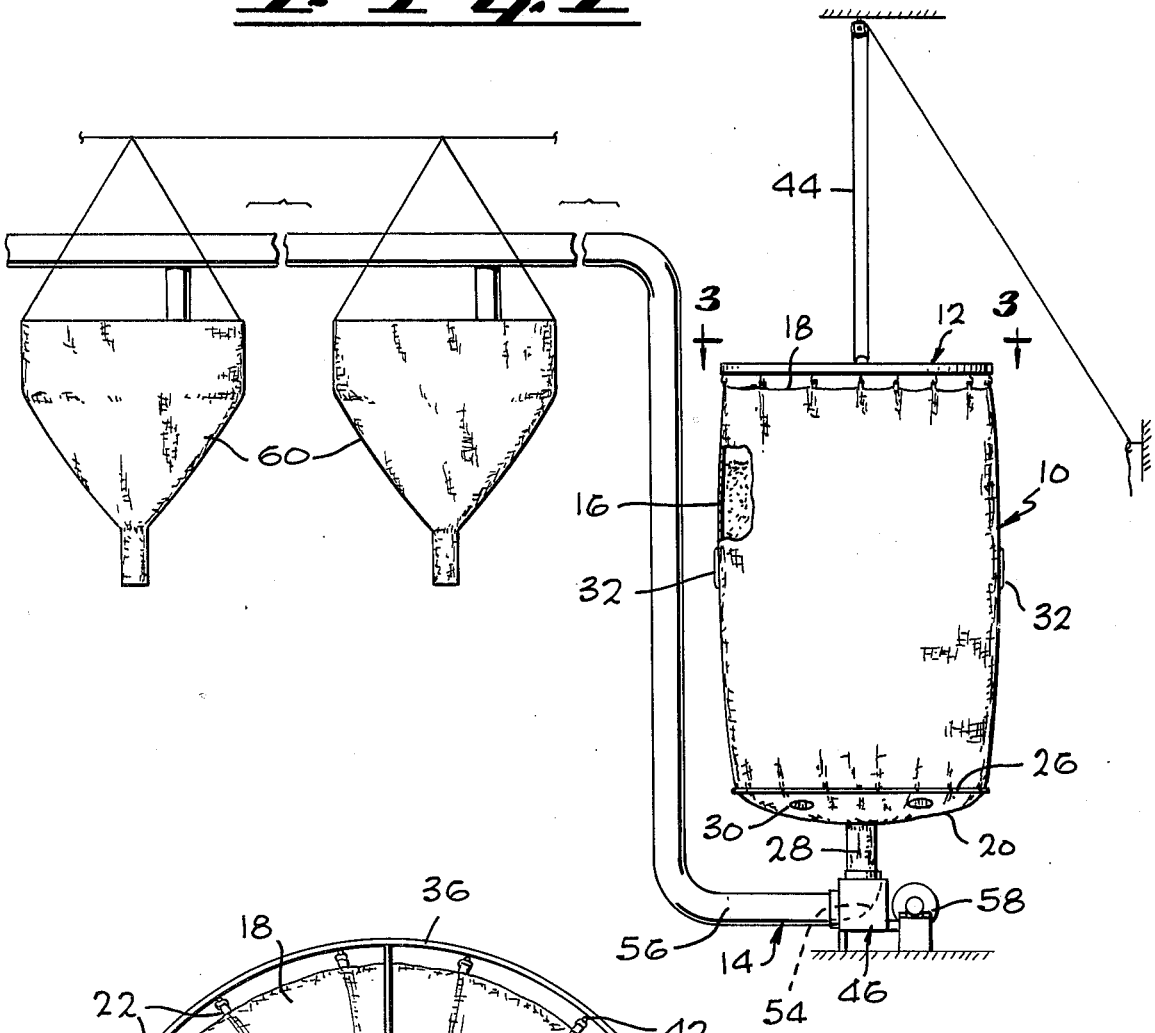
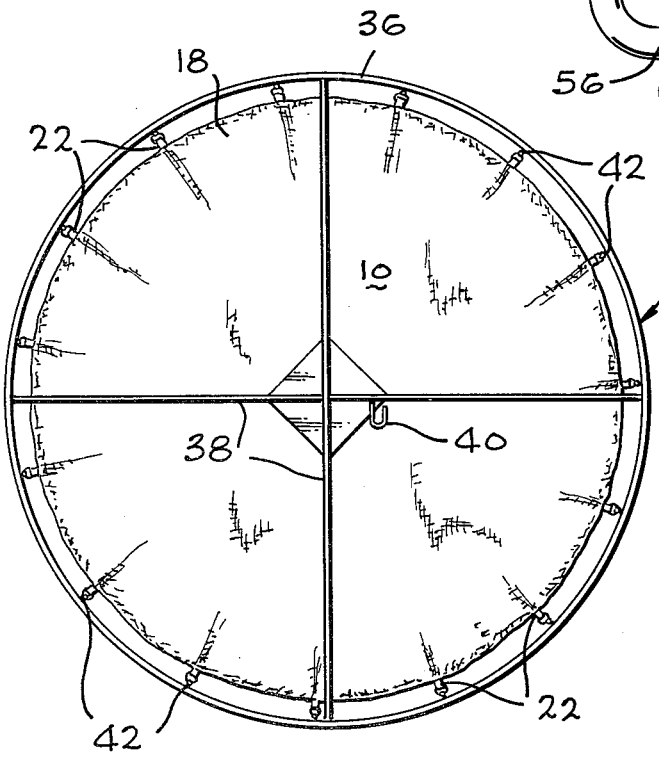
Fig. 3

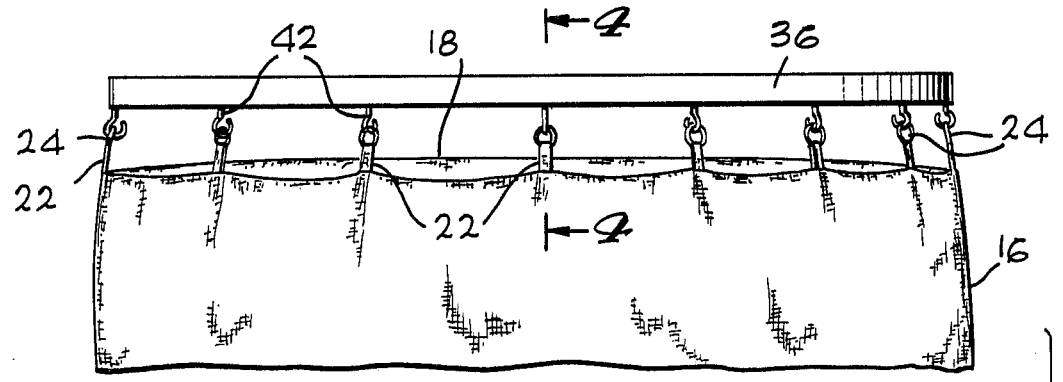
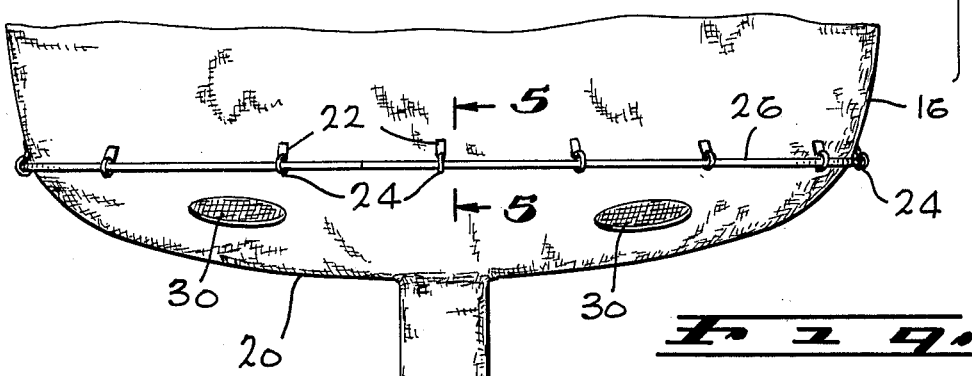
Fig. 2
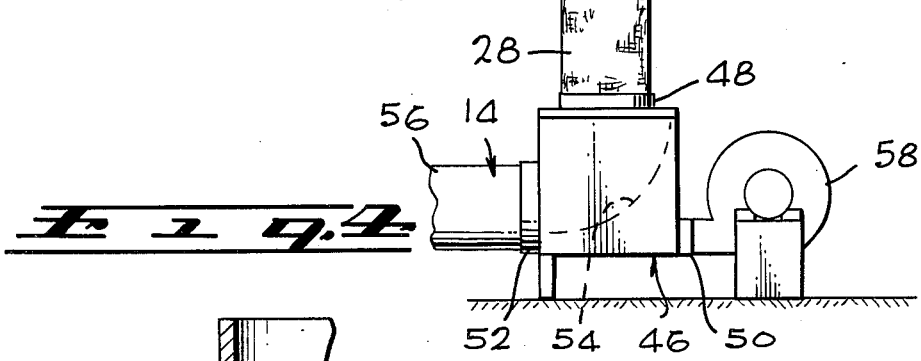
Fig. 4
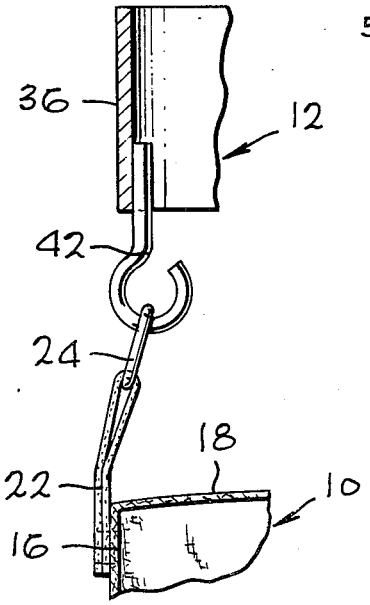
Fig. 5
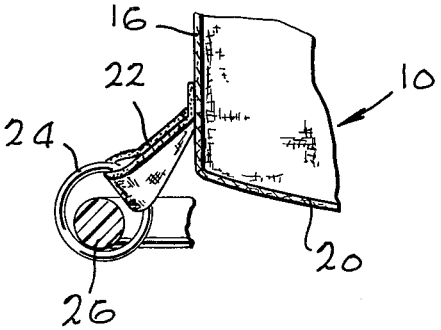

LOOSE FILL DISPENSING AND STORAGE SYSTEM

BACKGROUND OF THE INVENTION

1. Field of the Invention

This invention pertains to a storage, shipping and dispensing system for loose fill packaging material. More particularly, this invention pertains to dispensing containers for loose fill materials.

2. Description of the Prior Art

Loose fill packaging materials are a form of dunnage which are now typically manufactured of expanded polystyrene in various preselected shapes which may or may not be intended to provide interlocking characteristics when under some compression. However, all the expanded polystyrene loose fills currently in use are intended to provide readily flowable, lightweight dunnage materials of high volumetric efficiency and good strength in compression. The cost and ease of handling of loose fill permits it to be used with great advantage over other types of packaging, because an article to be protected within an outer container can very quickly be surrounded with an encompassing cushion of the loose fill, at very low added cost and with virtually no shipping penalty.

The practice in the loose fill industry has been to ship and store the loose fill in plastic bags of approximately 15 cubic feet or less capacity. Individual users have thereafter provided their own dispensing system for their own applications. Most typically, an overhead storage or hopper is built above the dispensing location, and the dispenser chute or hopper feeds the loose fill by gravity down into the area of use. Either the supply or the dispenser may be agitated when necessary to provide a continued flow. Loose fill is dispensed upon the opening of a dispensing valve. Dispensing valves previously in use utilized spring loaded squeeze actuated arrangements which have had a tendency to cause worker fatigue. Multi-station air conveyor systems have been used but lack convenience in loading of the loose fill into the systems.

Although a 15 cubic foot bag is bulky, it is so light (at 0.5 lbs/sq. in. density) that it may readily be handled. However, the same ease of dispensation which is one of the attractive advantages of loose fill means that many packages can rapidly be filled so that in a volume operation it is necessary to keep a relatively large supply of bags on hand, and to spend a substantial amount of time in unloading the bags into the dispensing systems. This manipulation and transportation of the bags, the necessity for dispensing equipment, and the costs of the bags themselves, should advantageously be avoided.

SUMMARY OF THE INVENTION

A storage, shipping and dispensing container for loose fill packaging material having a nominally extended shape comprises a pliant elongated bag having an elongated peripheral wall, an upper and a lower end. The lower end includes aperture means for dispensing the loose fill packaging material from the bag, closeable to prevent the flow of loose fill material during storage and shipping. Adjacent the upper end, means are provided for attaching the bag to a support arrangement for suspending the bag in a vertical position while maintaining the nominally extended shape adjacent the upper end. Adjacent the lower end, means are attached to the bag for maintaining the bag adjacent the lower end in the nominally extended shape when the attachment means adjacent the upper end is coupled to an upper support arrangement even when the bag is substantially empty.

In a more specific example, the bag is cylindrical having a fillable interior volume in excess of about 100 cubic feet and the lower end, when extended under the weight of packing material provides a tapered lower hopper. A group of rings disposed circumferentially about the bag adjacent the upper end are attached by tabs looped about the rings and joined to the bag. The bag is vertically supported in a dispensing mode by the group of rings. A different group of rings disposed circumferentially about the bag adjacent the lower end and coupled to the bag by a group of tabs joined to the bag and looped about the rings support a stiff resilient hoop extending through the rings adjacent the lower end. The hoop maintains the portion of the bag adjacent the lower end radially extended when the upper end is coupled to bag supports to limit downward bag elongation and droop of the lower end even when the bag contains a small quantity of loose fill packaging material. A conduit defining neck including the aperture extends from the lower end. Vents are provided at the lower end which prevent the escape of loose fill from the bag yet permit passage of air from the bag primarily during loading of the bag in an inverted position when vertically supported by the rings adjacent the lower end. The bag comprises a static charge resistant material to facilitate flow.

The support arrangement comprises a circular rim having a plurality of circumferentially spaced-apart hooks for receiving the rings of the upper end of the bag in a dispensing mode and the rings adjacent the lower end of the bag in a filling mode. Crosspieces traversing diameters of the rim include a central support element for attachment to a vertically adjustable pulley arrangement whereby the rim may be raised or lowered for bag installation.

The loose fill container may be used to dispense loose fill packaging material either directly or in conjunction with an air conveyor system. In accordance with this invention, a specific type of air conveyor system comprises in addition to the container and support arrangement, a transfer chute having an airstream inlet and a dunnage inlet. The dunnage inlet is gravity fed from the bag and receives packaging material from the neck of the container. A blower coupled to the airstream inlet of the transfer chute directs the flow of loose fill in the airstream through ducting coupled to remote hoppers to replenish the hoppers with loose fill packaging material on demand.

In accordance with this invention, when the loose fill packaging container is used directly as a dispenser, a stiff yet partially flexible hose couples the neck of the container to a collar of a dispensing valve. The collar is joined to a chamber defining guide housing for directing the flow of loose fill material. A weighed handle is disposed remote from a lateral axis passing through the housing towards the boundary of the collar. Pivot rods along the lateral axis extending into the housing chamber are coupled to the weighted handle. A valve gate within the chamber substantially covering the collar and preventing passage of loose fill is coupled along one end to the pivot rods along the lateral axis. Stop surfaces laterally disposed in the housing limits upward rotation of the gate. The weighed handle maintains the plate in a lateral normally closed position, with portions of the gate bearing on the stop surfaces. Manually lifting that handle opens the gate to allow loose fill to be dispensed through the housing.

BRIEF DESCRIPTION OF THE DRAWINGS

A better understanding of the invention may be had by reference to the following description taken in conjunction with the accompanying drawings, in which:

FIG. 1 is a diagrammatic plan view with portions exposed and portions broken away showing a loose fill dispensing system in accordance with this invention;

FIG. 2 is an enlarged plan view of a portion of the system depicted in FIG. 1, with portions removed;

FIG. 3 is an elevation plan view of a portion of the system taken along lines 3—3 of FIG. 1;

FIG. 4 is a fragmentary sectional view depicting the coupling of the bag to the support arrangement taken along lines 4—4 of FIG. 2;

FIG. 5 is a fragmentary sectional view depicting the hoop support taken along lines 5—5 of FIG. 2;

DETAILED DESCRIPTION

Figure 6:
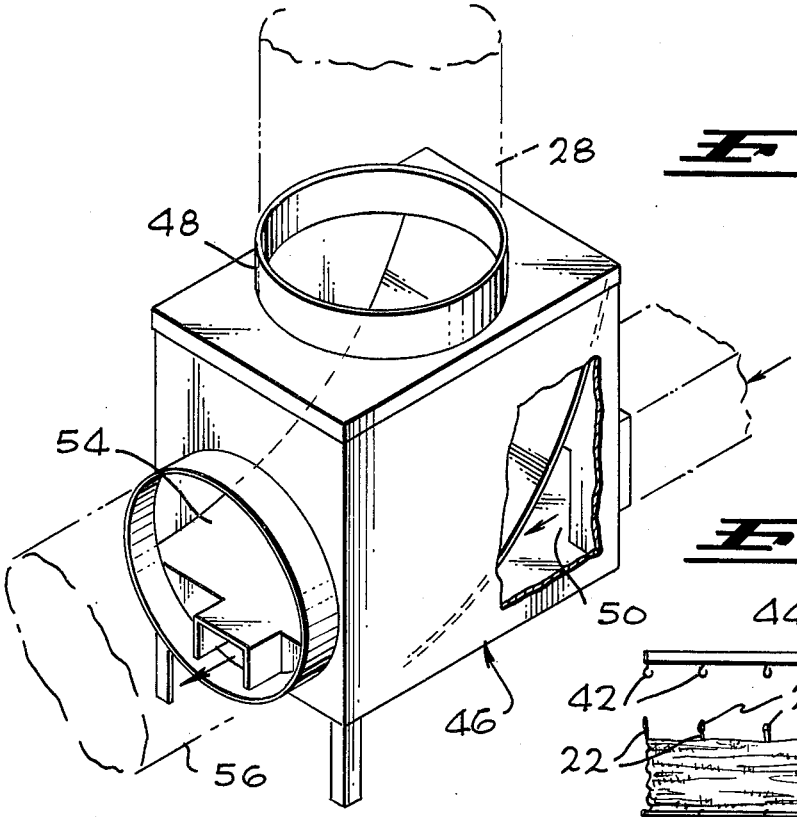
FIG. 6 is a perspective view of a portion of the system depicted in FIG. 1 with portions exposed and portions removed.

An example of a system for storing, shipping and dispensing loose fill packaging material in accordance with this invention, with particular reference to FIGS. 1, 2 and 3, generally comprises a storage, shipping and dispensing bag 10 vertically suspended from a support arrangement 12 and coupled to feed loose fill packaging material to stations remote from the bag 10 by an air conveyor system 14.

The bag 10 comprises a cylindrical peripheral wall 16, bound by spaced apart upper and lower ends 18, 20 generally normal to the wall 16. The bag is pliant and comprises a substantially static charge free material such as rubberized canvas. This provides a tough lightweight bag sufficiently rugged for repeated shipping under adverse conditions. Ease of flow in dispensation without agglomeration of the loose fill is aided by the static charge free material. The peripheral wall 16 comprises a sheet of material having overlapped side edges and stitched. The upper and lower ends 18, 20 are stitched at opposite ends of the wall 16.

Figure 8:
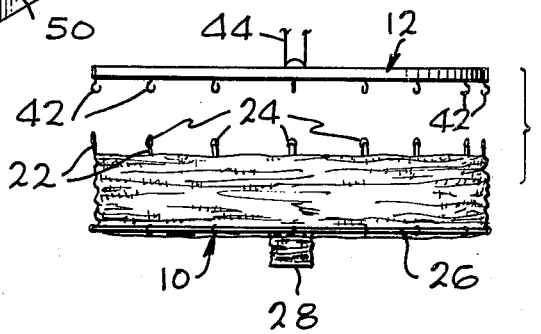
FIG. 8 is a diagrammatic plan view of the loose fill storage container depicted in FIG. 7 separated from the support arrangement and in a collapsed state.

The bag 10 has an interior volume in excess of about 100 cubic feet and preferably on the order of 150 cubic feet. This is provided by a nominal diameter of about five feet and a nominal height of about 7½ feet. The aforementioned dimensions have been found to present an optimal economic size for storing and transporting loose fill material. Bag cost per unit volume of loose fill material is low, yet the bag 10 is still sufficiently light when filled with expanded styrofoam, having a density on the order of 0.5 lb./cu.ft., to be carried by a single individual. The bag 10 is preferably cylindrical. Although bags may have other than round cross sections, the cylindrical bag is advantageous in that minimum outward distortion of volume occurs upon filling and the volume of loose fill packaging material being filled into the bag 10 is easily determinable. The bag 10 is sufficiently pliant so that it may be collapsed when empty, as shown in FIG. 8.

As best viewed in FIGS. 2 and 4, an upper group of spaced-apart tabs 22 are disposed circumferentially about the bag adjacent the upper end 18. A group of metal rings 24 are coupled to the bag by the tabs 22, the tabs 22 comprising a strip of material extending through the rings and having ends joined to the bag. The spaced-apart upper rings 24 provide means for suspending the bag 10 vertically in a dispensing mode from the support arrangement 12.

Figure 7:
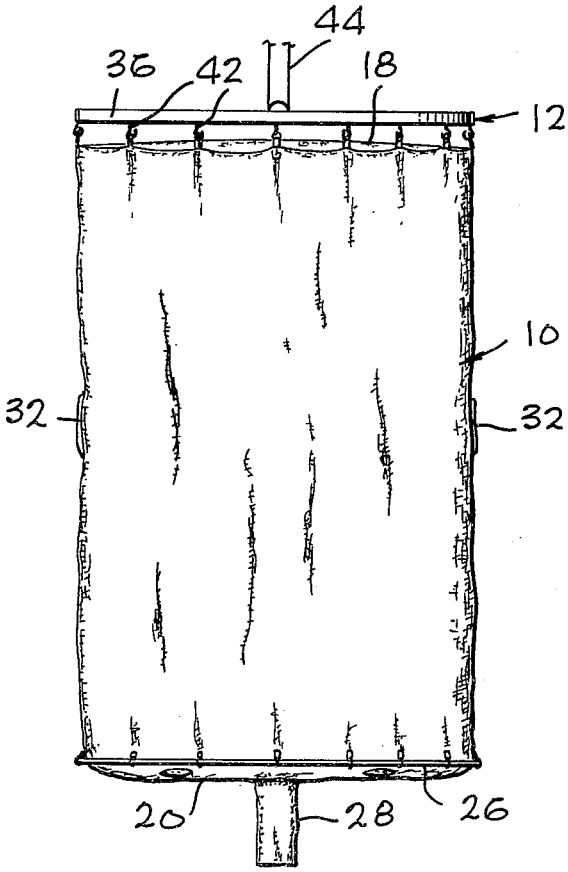
FIG. 7 is a plan view depicting the bag of FIG. 1 suspended from the vertical support arrangement and in a substantially empty state.

The lower end 20 also has a plurality of spaced-apart tabs 22 extending circumferentially about the bag adjacent the lower end 20, as viewed in FIGS. 2 and 5. A group of rings 24 disposed circumferentially about the bag are coupled to the bag by the lower tabs 22, which are also looped through the rings and stitched to the bag. A circular stiff resilient hoop 26 having a split end is concentric with and encompasses the bag 10 adjacent the lower end 20. The hoop 26 is encircled by each of the lower rings 24 to couple the hoop 26 to the bag 10. The ends of the hoop 26 are split to permit insertion and removal from the rings 24 if necessary. Fiberglass has found to be a suitable material for the hoop 26 in that the resilience of the material prevents distortion during rugged use in shipping and transporting the container. Were it not for the hoop 30, the bag, particularly adjacent the lower end 20 would have a tendency to be elongated and droop as much as a foot and a half. Particularly with the air conveyor system 14 this could be undesirable in that the lower end 20 may fall over the air conveyor apparatus and interfere with its operation. Thus, the hoop 26 is coupled to the bag 10 to maintain the portion of the bag 10 adjacent the lower end 20 radially extended when the upper end is coupled to the bag support arrangement 12. This limits bag elongation and droop of the lower end 20 even when the bag contains a small quantity of loose fill packaging material as viewed in FIG. 7.

A conduit defining neck 28 extends from the lower end 20 and includes an aperture for dispensing loose fill material from the container. A neck diameter of about 8 inches has been found to be suitable for use with expanded cup-shaped hemispherical loose fill packaging material having a diameter on the order of 1". The neck also comprises rubberized canvas material and is flexible so that it may be readily fitted over conduit and collars of various diameters yet may be crimped to prevent the loss of loose fill packaging material during transportation and other times when dispensing is not desired.

A plurality of vents 30 are provided on the upper end by mesh material covering vent apertures. The mesh is sufficiently fine to prevent loss of loose fill material from the bag 10 yet allows air to escape. The vents 30 are of primary importance in filling the container. The particular bag 10 depicted in FIG. 1 is intended to be filled with loose fill material when positioned in an inverted vertical position. The rings 24 adjacent the lower end 20 which join the hoop 26 to the bag 10 are also used to support the bag 10 when inverted for filling. The same support arrangement 12 may be used to support the bag 10 in the filling mode by connecting the lower rings 24 thereto. The bag is typically filled by a forced air system and the vents on the lower end 20 are at the uppermost end of the bag 10 when in an inverted position for filling. Thus, the vents 30 are not blocked by loose fill material which would otherwise partially block the air from escaping. In some situations, it may be desirable to have bags filled in other than a vertically inverted position and vents may be located elsewhere on the bag.

Spaced-apart longitudinally disposed straps 32 are stitched to the wall 16 to enable the bag 10 to be grasped and carried by a single individual. Typically, the bag may weigh about 8 or 10 lbs. and when filled with about 150 cubic feet of loose fill packaging material still only weighs on the order of 60 lbs.

When filled with loose fill packaging material, the lower end 20 of the bag 10 extends downward, providing a tapered lower hopper by which the loose fill material feeds into the neck 28. The tapering, to a limited extent, helps feed loose fill remaining in the bag when the bag 10 is nearly empty. The importance of the hopper effect is minimized when used with an air conveyor system in which a venturi effect causes remaining loose fill material to be sucked downward through the neck 28.

With particular reference to FIGS. 2, 3 and 4, the support arrangement 12 comprises a circular steel rim 36, a pair of normally disposed and intersecting crosspieces 38 each traversing a diameter of the rim and welded thereto. A hook providing a main support element 40 is disposed within the center of gravity of the rim unit and joined to one of the crosspieces 38. A plurality of circumferentially spaced-apart support elements or hooks 42 depend from the rim to receive the rings 24 of the bag 10. A pulley arrangement 44 includes a cord coupled to the main support element 40 of the rim 36 allowing the rim 36 to be raised and lowered to adjust the position of the bag 10 for dispensing. The bag may be dropped to collapse when empty, such as indicated in FIG. 8 to enable the rings 24 adjacent the upper end 18 to be easily removed from the hooks 42. The rings 24, joined to the tabs 22, have a moderate degree of flexibility in positioning with respect to the bag 10 so that the rings 24 may be easily positioned over the hooks 42. The support arrangement 12 may also be used when filling the bag 10. The rings 24 adjacent the lower end 20 are positioned over the hooks 42. As indicated, the bag is filled in an inverted position, the neck 28 and lower end 20 of the bag 10 being directed upward. Both the upper and lower rings 24 and the hooks 42 are disposed circumferentially about the bag 10 and the rim 36 in an equidistant spaced-apart relationship to provide universal matched positioning of the rings 24 and hooks 42.

With particular reference to FIGS. 1, 2 and 6, the air conveyor system 14 comprises a transfer chute 46 having a dunnage path including an inlet collar 48, an airstream path including an inlet 50 and an outlet 52 in fluid communication with both the dunnage inlet 48 and the airstream inlet 50. The transfer chute 46 has a curved sloping surface 54 directing loose fill material from the bag 10 to ducting 56. A blower 58 directs an airstream beneath the sloping surface 54 through the airstream inlet 50 and the loose fill material and airstream are combined and directed through the ducting 56. The ducting 56 feeds into a plurality of remotely located hoppers 60. When 1" diameter hemispherical or cupped loose fill packaging material is utilized in this system, such as with 8" ducting, a 1 horsepower blower typically is sufficient to continuously and intermittently deliver loose fill material to the hoppers 60 over a lateral distance of about 150'-200' and vertically upward about 12' to 18'. When hemispherical loose fill material is used in this system, the hoppers 60 are replenished on demand without the necessity for starting and stopping the blower 58 even when the ducting 56 is substantially filled with loose fill material.

Figure 9:
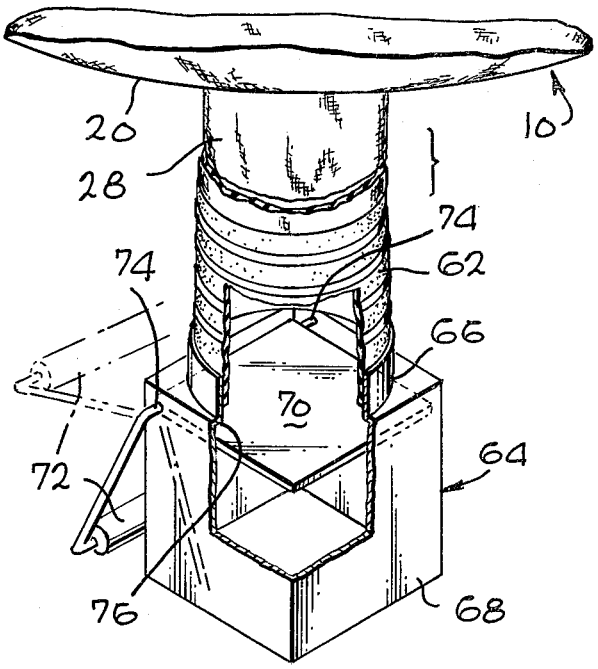
FIG. 9 is a perspective view with portions broken away and portions exposed of a different example of a loose fill dispensing system in accordance with this invention.

A different example of a dispensing system is shown in FIG. 9 in which the bag 10 in accordance with this invention directly dispenses loose fill without an air conveyor system. The neck 28 of the bag 10 is fitted about a stiff but flexible hose 62. The hose enables the loose fill material to be easily directed into a container which is to be fitted. A dispensing valve 64 is coupled to the hose 62 opposite the end coupled to the neck to control dispensing of loose fill packaging material. The dispensing valve 64 comprises a cylindrical collar 66 to which the hose 62 is attached. A rectangular guide housing 68 disposed beneath the collar 66 directs loose fill material to its final destination and additionally includes a valve gate 70 to control the flow of loose fill packaging material. A weighted handle 72 is disposed parallel to and remote from a lateral axis passing through the housing normally maintaining the gate 70 in a blocked flow position. Pivot rods 74 along the lateral axis extend into the housing and are coupled to the weighted handle 72. The valve gate 70 comprising a metal plate substantially covers the collar 66 and prevents passage of loose fill from the collar 66 to the chamber of the guide housing 68. The valve gate 70 is coupled along one end to the pivot rods 74 along the lateral axis so that the valve gate 70 may be pivoted from one position in which the valve gate 70 blocks the collar passageway, to a second position in which the valve gate 70 allows loose fill material to pass through the collar 66 and the guide housing 68. Limit surfaces 76 laterally disposed within the housing prevent upward rotation of the gate 70. The weighted handle 72 maintains the gate 70 in a normally closed position. Manually lifting the handle 72 opens the gate 70 to allow loose fill to pass through the guide housing 68. This valve arrangement provides a particularly desirable dispensing system which minimizes worker's fatigue.

Thus, the bag 10 provides a lightweight portable loose fill packaging, storage and dispensing container which maintains its longitudinal shape during use, is collapsible for convenient transport when empty and may easily be positioned to dispense packaging material. The bag 10 is easily fitted on the support arrangement 12 in a dispensing or filling mode. The neck 28 of the bag 10 is readily joined to the air conveyor 14 to deliver loose fill at locations remote from the bag or coupled to the dispensing valve 64 providing an individual dispensing station.

While the invention has been particularly shown and described with reference to preferred examples thereof, it will be understood by those skilled in the art that various changes in form and details may be made therein without departing from the spirit and scope of the invention.

What is claimed is:

1. A dunnage container for storing, shipping and dispensing loose fill packaging material comprising:

a pliant, substantially static free elongated bag having a nominal extended shape when filled and comprising a cylindrical wall, a lower end providing a tapered lower hopper when extended and an upper end;

the upper end having means disposed circumferentially thereabout for attachment to plural circumferentially disposed support elements to suspend the bag in the nominal extended shape adjacent the upper end and comprising an upper group of spaced-apart rings coupled to the bag, the rings being supportable on a circumferentially spaced-apart group of hooks to suspend the bag in a dispensing mode;

a stiff hoop extending about the cylindrical wall adjacent the lower end and means coupling the hoop about the bag adjacent the lower end, the hoop comprising a resilient material and being coupled to maintain the bag adjacent the lower end radially extended to the nominal shape when the upper end is coupled to bag supports to thereby limit downward bag elongation and droop of the lower end even when the bag contains only a small quantity of loose fill packaging material, the means coupling the hoop about the bag adjacent the lower end comprising a lower group of spaced-apart rings disposed circumferentially adjacent the lower end and coupled to the bag, each ring encircling the hoop;

a conduit defining neck extending from the lower end including aperture means for dispensing loose fill packaging material, the bag thereby providing a lightweight portable loose fill packaging storage and dispensing container which substantially maintains its longitudinal shape during use, is collapsible for convenient transport when empty and may easily be positioned to dispense packaging material, the neck comprising a flexible material to enable the neck to conform to various conduit and coupling diameters and to be manually crimped to prevent packaging material from escaping when the bag is transported and when not in use;

at least one vent for allowing passage of air yet preventing passage of packing material to allow the bag to release air in a filling mode when suspended in an inverted vertical position in which the lower end is directed generally upward;

the vent comprising a mesh patch disposed on the lower end;

an upper group and a lower group of spaced-apart tabs, each tab being looped about a different ring of the upper group and the lower group of spaced-apart rings and fastened to the bag adjacent respective upper and lower ends to flexibly couple the upper and lower rings thereto; and the bag further comprising means disposed on the outer cylindrical wall to manually grasp and carry the container when extended with packing material.

2. A dunnage container for storing and shipping loose fill packaging material, the container also for dispensing packing material in conjunction with an arrangement comprising an adjustable height, multiple coupling upper support arrangement, a conduit coupled transfer chute for distributing loose fill packing material to stations remote from the dispensing container and a blower coupled to the transfer chute to feed packing material through the conduit; the container comprising:

a pliant cylindrical bag having a circular peripheral wall, an upper end and a lower end;

the lower end extending downwardly when the bag contains a quantity of packing material and a neck extending downwardly from the lower end, the neck including aperture means for releasing packing material under gravity to the conduit coupled transfer chute;

a stiff resilient hoop extending about the bag and concentric therewith adjacent the lower end and coupled thereto to maintain the bag adjacent the lower end in tension in a radially extended position, thereby preventing the lower end from collapsing about the conduit coupled transfer chute upon emptying of the bag;

means coupled to the bag adjacent the upper end for suspending the bag vertically in a dispensing mode from the upper support arrangement while maintaining the bag adjacent the upper end in a radially extended position;

at least one air vent aperture on the lower end and mesh material covering the air vent aperture, the mesh preventing escape of packing material yet permitting air to be released from the bag when the bag is filled in an inverted position;

a plurality of rings circumferentially spaced apart about the bag and joined thereto adjacent the lower end coupling the hoop to the bag;

a plurality of tabs coupled in spaced-apart relation to the bag adjacent the upper end, and in which the means for suspending the bag comprises a different plurality of rings circumferentially spaced about the bag and joined to the tabs adjacent the upper end.

3. The invention as set forth in claim 2 and in which the bag has a fillable interior volume in excess of about 100 cu. ft. and comprises a fabric impregnated with a static charge resistant flexible material, the stiff hoop comprising a lightweight resilient split ring element and the bag comprising a strap disposed along the cylindrical wall for carrying the container when filled with packing material.

4. A dunnage system for storing, shipping and dispensing loose fill packaging material comprising:

a vertically adjustable upper support arrangement comprising a plurality of support elements disposed circumferentially about a support rim, the support elements comprising a plurality of support hooks and the upper support arrangement comprising a central support element for coupling the rim to a vertically adjustable pulley;

a flexible pliant cylindrical bag having a peripheral wall, an upper end and a lower end;

means extending circumferentially about the bag adjacent the upper end for suspending the bag from the support elements;

a neck extending from the lower end including aperture means for dispensing loose fill packaging material from the container;

a gravity fed transfer chute including a dunnage inlet for receiving packaging material from the neck of the container, an airstream inlet for directing an airstream to ducting and an outlet in fluid communication with the airstream inlet and the dunnage inlet for passing the packaging material in mixed flow relationship to the airstream, through ducting;

blower means coupled to the transfer chute airstream inlet for directing packaging material through the ducting;

means coupled to and encompassing the bag adjacent the lower end for maintaining the bag adjacent the lower end in a radially extended shape, thereby preventing the lower end from collapsing over the blower and the transfer chute when limited packing material remains in the bag, thereby providing a readily loaded loose fill dispensing system capable of feeding loose fill to stations remote from the bag, the means for maintaining the bag adjacent the lower end in a radially extended shape comprising a stiff hoop;

ventilation means for permitting air to enter and escape from the bag to facilitate the loading of packing material into the bag while preventing escape of packing material;

the hoop comprising a lightweight resilient material and the bag comprising a plurality of rings coupled thereto circumferentially spaced apart adjacent the lower end, each ring encircling the stiff hoop coupling the hoop in tensioning relationship to the bag;

the means for suspending the bag comprising a different plurality of rings circumferentially spaced apart about the bag adjacent the upper end, each of said last mentioned rings being supported by a different one of the depending hooks; and at least one strap for manually carrying the container when filled with dunnage material.

5. A dunnage system for storing, shipping and dispensing loose fill packaging material comprising:

a pliant bag having a cylindrical wall, an upper end, a lower end and a neck including an aperture extending from the lower end;

the upper end having means disposed circumferentially thereabout for attachment to plural circumferentially disposed support elements;

a stiff hoop extending about the cylindrical wall adjacent the lower end, the cylindrical wall being radially extended when filled with loose fill packaging material, the hoop coupled to the bag to maintain the bag adjacent the lower end radially extended when the upper end is coupled to bag supports to thereby limit bag elongation and droop of the lower end even when the bag contains only a small quantity of loose fill packaging material;

means coupling the hoop circumferentially about the bag adjacent the lower end;

a dispensing valve coupled to the neck, the dispensing valve comprising guide housing means defining a chamber therein for guiding the direction in which loose fill is dispensed; gate means pivotally coupled to the housing and disposed within the chamber, the gate means defining one position blocking the flow of loose fill and another position allowing the flow of loose fill, the gate means being movable from the one position to the other;

means disposed external to the housing and coupled to the gate means for moving the gate means from the one position to the other position, the means disposed external to the housing comprising a weighted handle normally maintaining the gate means in the blocked flow position;

a collar joined to the housing;

a stiff flexible hose coupling the neck of the bag to the collar;

the stiff hoop comprising a resilient material;

the means disposed circumferentially about the upper end comprising an upper group of spaced-apart rings coupled to the bag, the rings being supportable on a circumferentially spaced apart group of hooks to suspend the bag in a dispensing mode;

the hoop coupling means comprising a lower group of spaced-apart rings disposed circumferentially adjacent the lower end and coupled to the bag, each ring encircling the hoop; and an upper group and a lower group of spaced-apart tabs, each tab being looped about a different ring of the upper and lower groups and fastened to the bag adjacent respective upper and lower ends to flexibly couple the upper and lower rings thereto.

* * * * *